United States Patent [19]

Camardella

[11] 4,185,789

[45] Jan. 29, 1980

[54] STRUCTURE OF A MULTIPLE WIREGUIDE

[75] Inventor: Giuseppe Camardella, Saronno, Italy

[73] Assignee: Tekma Kinomat S.p.A., Caronno Pertusella, Italy

[21] Appl. No.: 852,526

[22] Filed: Nov. 17, 1977

[30] Foreign Application Priority Data

Nov. 4, 1976 [IT] Italy ..... 29697 A/76

[51] Int. Cl.[2] ..... H01F 41/06

[52] U.S. Cl. ..... 242/7.11; 242/7.14

[58] Field of Search ..... 242/7.11, 7.09, 7.14, 242/53; 140/92.1

[56] References Cited

U.S. PATENT DOCUMENTS

| | | | |
|---|---|---|---|
| 2,855,159 | 10/1958 | Mallina | 242/7.11 X |
| 3,402,903 | 9/1968 | Camardella | 242/158.5 |
| 3,410,317 | 11/1968 | Rondas | 242/7.09 |
| 3,658,269 | 4/1972 | Camardella | 242/7.11 |
| 4,020,996 | 5/1977 | Deeg | 242/7.11 |

*Primary Examiner*—Billy S. Taylor

*Attorney, Agent, or Firm*—Young & Thompson

[57] ABSTRACT

A multiple wire guide for coil winding machines, said wire guide being made to rotate about its axis and to slide along its axis, comprising a plurality of individual wire guides fixed on a rectilinear connecting rod support and equally spaced from one another, said rod support being mounted on two synchronously rotatable eccentric pins, the eccentricity of which may be adjusted.

6 Claims, 5 Drawing Figures

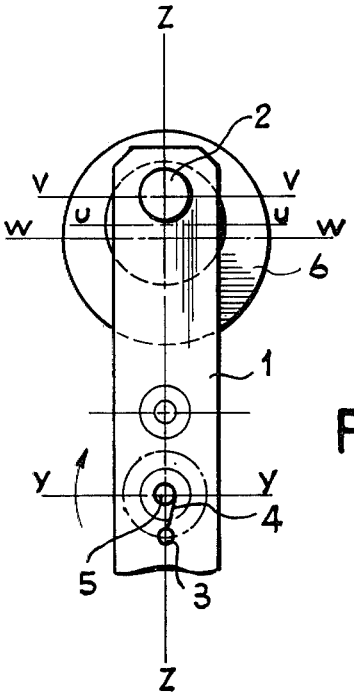
FIG. 3
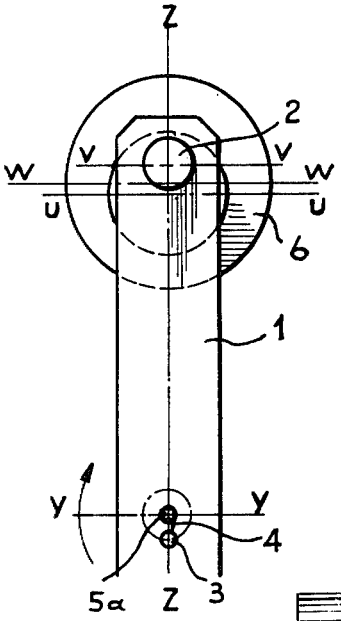
FIG. 4
FIG. 5
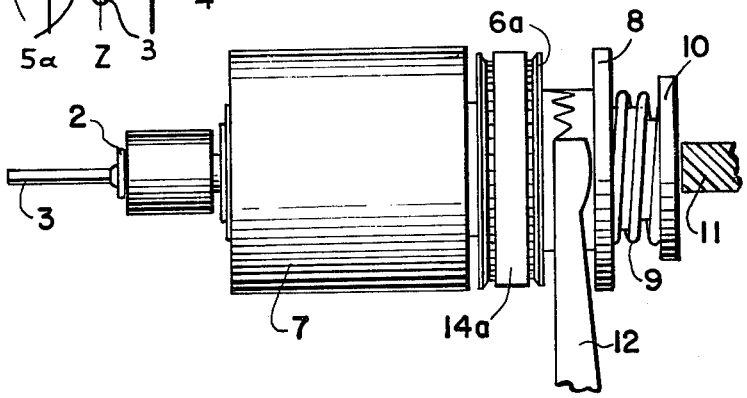

STRUCTURE OF A MULTIPLE WIREGUIDE

BACKGROUND OF THE INVENTION

1. Field of the Invention

This invention relates to turret coil winding machines, in which the coil supports are fixed on a stepwise rotatable turret which transfers them into a succession of fixed working stations distributed uniformly at the periphery of the turret, and the coil is wound by a winding head disposed in one of said working stations and comprising a wire guide which rotates about its own axis and slides along the same axis.

More particularly, the invention relates to a multiple wire guide forming part of the winding head, and arranged to simultaneously wind several coils on coil supports disposed side-by-side.

2. Description of the prior art

Normally, each winding head is provided with a single main drive shaft with which a single wire guide is associated, for example as described in my U.S. Pat. No. 3,402,903, and which winds only one coil at a time.

However, the need has been felt to wind several coils simultaneously.

Italian Pat. No. 792,849, of the same applicant, describes a special multiple wire guide comprising a plurality of wireguides rotatably mounted on a single support and rotated by the single main shaft which drives a normal winding head.

In said Italian Pat. No. 792,849, the individual wire guides of the multiple wire guide are each mounted independently rotatable on said common support, each integral with a driving gear wheel. All the gear wheels are in mutual engagement via a plurality of idle pinions and a further main pinion keyed on to the main drive shaft.

This method has been proved very effective, in particular as a simple method of converting a coil winding machine with a single wire guide into a machine with several wire guides able to wind several coils simultaneously.

However, it has technical limitations both with regard to the number of wire guides which can be mounted on said common support, and with regard to the minimum distance between one wire guide and another, which is determined by the overall size of the driving gear wheels and pinions. This method is also relatively costly due both to the cost of the drive gears and, in particular, the cost of the various bushes in which the individual wire guides rotate.

SUMMARY OF THE INVENTION

The main object of the present invention is to provide a multiple wire guide which can comprise any number of individual wire guides, their distance apart being limited only by the radial dimension of the wire guide or the radial dimension of the coils to be wound simultaneously.

A further object of the present invention is to provide a multiple wire guide of this type, which is simple to construct and of low cost.

A further important object of the present invention is to provide a multiple wire guide in which the individual wire guides are able to wind coils to a winding diameter determined each time in accordance with the transverse dimensions of the coils.

Finally, another important object of the present invention is to provide a multiple wire guide, the individual wire guides of which are also able to twist, that is, to wind the ends of the winding on to the coil terminals with a twisting or winding diameter which is different from the coil winding diameter.

All these results are obtained in that all the wire guides of the multiple wire guide are fixed on a connecting rod support, and the ends of the connecting rod support are mounted on synchronously rotatable eccentric pins.

More particularly, said eccentric pins are keyed coaxially and eccentrically on to a pair of respective drive shafts, drive pulleys being associated with these latter and connected together by a common motion transmission deriving from the single main drive shaft for the machine.

According to a further important characteristic, said drive pulleys for the drive shafts are set eccentrically to the shafts themselves, means being provided to vary the setting angle in synchronism on both shafts.

BRIEF DESCRIPTION OF THE DRAWING

Further characteristics and advantages of the present invention will be more evident from the description given hereinafter of a preferred embodiment illustrated by way of example in the accompanying drawings in which:

FIGS. 3 and 4 diagrammatically indicate the method of operating the multiple wire guide in two different setting positions.

FIG. 5 is a top plan view of the structure shown in FIG. 1.

DESCRIPTION OF THE PREFERRED EMBODIMENT

Figure 1:
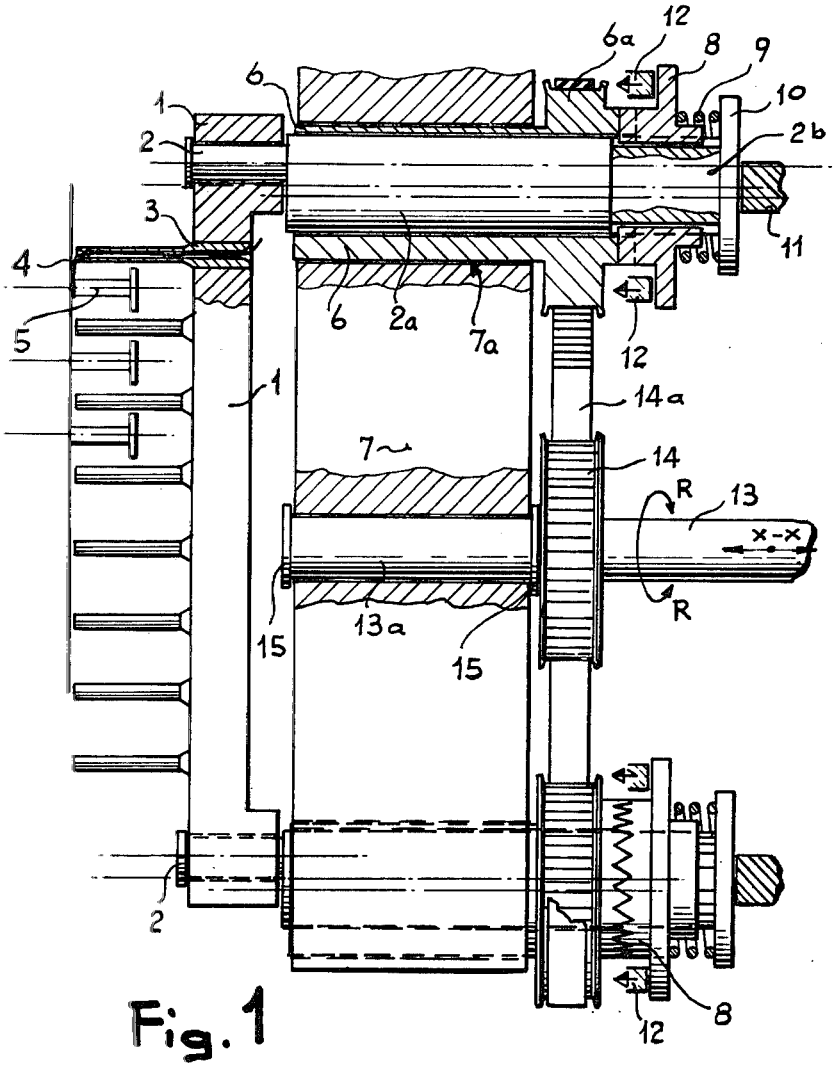
FIG. 1 is a diagrammatic axial section through the multiple wire guide unit according to the invention.

As shown, the multiple wire guide according to the invention comprises a connecting rod support 1 mounted on pins 2 at its ends.

Several wire guides 3 essentially in the form of hollow tubes are fixed on the connecting rod support 1. A description of the structure of the individual wire guides 3, which is well known from similar machines, is considered unnecessary.

A wire 4, fed from a respective feed spool, not shown, runs through each of the wire guides 3 to form a coil by winding on the coil support 5 in known manner. Eight wire guides are shown on the drawing, mounted in parallel on the connecting rod support 1, each of which winds on to a corresponding fixed coil support 5.

The two pins 2 are keyed eccentrically on the two shafts 2*a*, which are rotatably mounted in sleeves 6.

These latter are also rotatable in a corresponding seat 7*a* of a main support 7, which is common to the two assemblies formed from the shafts 2*a* and sleeves 6.

A pulley 6*a* is integral with each of the sleeves 6 at the end opposite to the pin 2. The axis of rotation of the pulley coincides with the axis of rotation of the sleeve 6 in its seat 7*a*. The axis of rotation of the shaft 2*a* in the sleeve 6 is eccentric to the axis of the sleeve 6.

A wheel 8 is mounted on an axial extension 2*b* of the shaft 2*a* at the end opposite to the pin 2, and constitutes a clutch with axial teeth which cooperate with corresponding axial teeth on the pulley 6*a* (see the bottom part of FIG. 1), the wheel 8 being axially slidable on the extension 2b of the shaft 2a, but not rotatable about it. An axial spring 9 disposed between the wheel 8 and an end flange 10 of the extension 2b tends to keep the toothed clutch engaged, i.e. to keep the wheel 8 and pulley 6a rigidly connected.

Figure 2:
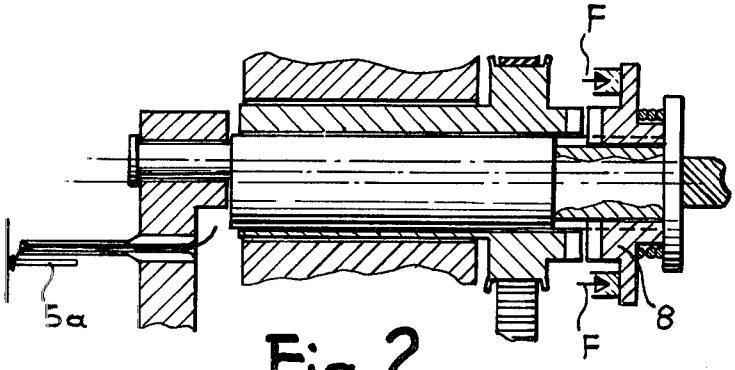
FIG. 2 shows a detail of said unit in the position for changing the setting angle.

The toothed clutch may be disengaged for the purpose described hereinafter, by acting on the flanged edge of the wheel 8 in the direction indicated by the arrows F of FIG. 2, using an operating fork, only the ends 12 of which are shown.

The common support 7 is provided centrally with a pin 13a constituting an extension of the main shaft 13 which drives the winding head. The pulley 14 is keyed on the shaft 13, 13a, and engages with a toothed belt 14a passing over the two pulleys 6a and forming a common motion transmission.

The central pin 13a is freely rotatable in the support block 7, but is locked axially by a pair of end flanges 15.

Because of this construction, the axial movements of the main shaft 13 are followed exactly by the support block 7 and thus by the connecting rod support 1, and finally by the individual wire guides 3.

The rotation of the shaft 13 is followed by the pulley 14, by the toothed belt 14a and thus by the two pulleys 6a. Thanks to the toothed clutches 8, engaged under the action of the spring 9, the rotation of the pulley 6a is exactly followed by the shaft 2a and thus by the eccentric pin 2. As the arrangement of the upper and lower pins 2 is exactly symmetrical, the rotary movement of the axis of the two pins 2 is exactly reproduced by the entire connecting rod support 1, and thus finally by the individual wire guides 3.

As shown in FIGS. 3 and 4, the circular trajectory followed by each of the wire guides 3 has a diameter which is determined by the eccentricity of the pin 2 to the axis of rotation of the assembly, which coincides with the axis of rotation of the pulley 6a. This eccentricity is determined by the position of the shaft 2a relative to its sleeve 6.

For better understanding of the drawing, the various axes of rotation are represented as the intersection of the vertical central plane Z/Z of the multiple wire guide unit, with the following horizontal planes:

- Y/Y, which defines the axis of rotation of one of the individual wire guides 3;
- V/V, which defines the axis of the pin 2;
- U/U, which defines the axis of the shaft 2a (the distance between the axis of the pin 2 and the axis of the shaft 2a is invariable, as the former is keyed on the latter);
- W/W, which defines the axis of the sleeve 6.

In the case of FIG. 3, the eccentricity of the pin 2, i.e. the distance between the pin axis and the axis of the sleeve 6, is given by the sum of the distance between V/V and U/U and the distance between U/U and W/W. From the drawing it can be seen that the sum of these two distances is equal to the distance of the centre of the wire guide 3 from its centre of rotation, at the intersection of Z/Z with Y/Y.

In the case of FIG. 4, the sleeve 6 has been rotated by 180° about its axis, in respect of the position shown in FIG. 3. Consequently, the distance between the axis of the pin 2 and the axis of the sleeve 6 results as difference of the distance between V/V and U/U minus the distance between U/U and W/W. From FIG. 4, it is in fact evident that this difference is actually equal to the distance between the centre of the wire guide 3 and its centre of rotation, at the intersection of the planes Z/Z and Y/Y.

The operation of the multiple wire guide unit heretofore described is quite evident:

- in the position shown in FIGS. 1 and 3, the positional relationship between the pin 2, shaft 2a and sleeve 6 is such that each individual wire guide 3 is displaced from the axis of the relative coil 5 to be wound, by an amount sufficient to enable the wire guide to freely rotate about the coil;
- the machine may therefore be started in this position, and the movements of the main drive shaft 13, both in the axial direction X—X and in the rotary direction R—R, are reproduced exactly by each of the wire guides 3, to enable the winding of each coil to be formed;
- after the coils have been wound, the shaft 13 is stopped. The toothed clutches 8 are then disengaged by acting with the fork 12 on the flanged edge of the wheel 8 against the action of the spring 9;
- the shaft 13 is then rotated through a single half turn, i.e. 180°, with the toothed clutches disengaged. During this operation, the rotary movement of the shaft 13 is followed only by the pulleys 6a and sleeves 6. This is because the pressure of the fork 12 on the flange of the wheel 8 and the possible resting of the head of the extension 2b of the shaft 2a against a fixed stop 11 lock the shaft 2a and prevent it being dragged by the rotation of the sleeve 6. Consequently, the sleeve 6 changes its position relative to the shaft 2a, to arrive at the position shown in FIGS. 2 and 4;
- in this second position, the eccentricity of the pin 2 is much less (as seen heretofore in relation to the description of FIG. 4), so that each of the wire guides is now able to make a rotation over a circular trajectory of a much smaller diameter. This rotation in a circle of very small diameter enables each of the individual wire guides to twist or wind the end of the winding on the respective coil terminal (after positioning means, not shown, have moved the coil support to bring the relative terminal into a position coinciding with the axis of rotation of the wire guide) without interfering with the end of the coil;
- a new twisting operation is carried out with the same reduced eccentricity, after again moving the coil supports to make the initial terminal of a new coil coincide with the axis of rotation of the wire guide;
- the axis of the new coil is then again made to coincide with the axis of rotation of the wire guide, and the new coil is then wound. This procedure is repeated for all the other coils mounted on the same support.

Although the invention has been described with reference to one particular embodiment and one particular type of use, it embraces any other modification available to an expert of the art. In particular, neither the special toothed coupling means between the shafts 2a and the sleeve 6, nor the special motion transmission system using the toothed belt 14a—as illustrated—are to be considered as limiting, but merely as explanatory, nor is the particular use proposed (the alternate winding of a coil and the twisting of the winding ends on the terminals), or the particular 180° change in the setting angle. Other mechanical systems may be used with equivalent results, and other uses may be envisaged, such as the winding of coils of different diameters, or any other setting angle may be chosen in relation to the required eccentricity value, without thereby departing from the scope of the invention itself.

I claim:

1. In a coil winding machine, a multiple wire guide comprising a support, a plurality of wire guides of said support, two parallel pins rotatably connected to said support for driving said support in a circular path, means for moving said pins in circular paths of the same diameter about two spaced parallel axes, and means to adjust the eccentricity of said pins relative to said axes thereby selectively to change the diameter of said circular path followed by said support.

2. A machine as claimed in claim 1, said means for moving said pins comprising a pair of parallel sleeves mounted for rotation in a common support, a shaft mounted eccentrically and rotatably in each said sleeve, a said pin being carried eccentrically by each said shaft, and means for rotating said sleeves in unison.

3. A machine as claimed in claim 2, said means to adjust the eccentricity of said pins comprising means simultaneously to rotate each said shaft and sleeve relative to each other through the same angle.

4. A machine as claimed in claim 2, there being a pulley on each said sleeve, a drive member interconnecting the driving said pulleys, and means to circulate said drive member to rotate said pulleys in unison.

5. A machine as claimed in claim 3, said means to adjust the eccentricity of said pins comprising clutch means releasably interconnecting each said shaft relative to its associated said sleeve for conjoint rotation, and means for selectively releasing said clutch means to permit rotation of each said shaft and sleeve relative to each other.

6. A machine as claimed in claim 5, said clutch means comprising a wheel mounted axially slidably but non-rotatably on each said shaft, said wheel having axial clutch teeth thereon that engage with axial clutch teeth on the associated said sleeve, spring means urging the clutch teeth of the wheel and sleeve into engagement with each other thereby to lock each shaft to its associated said sleeve for conjoint rotation therewith, and means to slide said wheel axially away from said associated sleeve to disengage said teeth to permit relative rotation of said shaft and its associated said sleeve.

* * * * *